United States Patent [19]

Horn

[11] 4,033,603

[45] July 5, 1977

[54] SAFETY SKI BINDING

[75] Inventor: Hans Horn, Bern, Switzerland

[73] Assignee: Gertsch AG, Baar, Zug, Switzerland

[22] Filed: July 16, 1975

[21] Appl. No.: 596,265

[30] Foreign Application Priority Data

July 26, 1974 Austria ..... 66182/74
Oct. 30, 1974 Austria ..... 8711/74

[52] U.S. Cl. ..... 280/618
[51] Int. Cl.[2] ..... A63C 9/08
[58] Field of Search ..... 280/11.35 K, 11.35 Y, 280/11.35 E, 11.35 D, 11.35 A, 11.35 C, 11.35 T, 11.35 R, 618, 611, 623, 617

[56] References Cited

UNITED STATES PATENTS

| | | | |
|---|---|---|---|
| 2,383,064 | 8/1945 | Lanz | 280/11.35 Y |
| 3,027,173 | 3/1962 | Beyl | 280/629 |
| 3,489,424 | 1/1970 | Gertsch et al. | 280/11.35 K |
| 3,647,235 | 3/1972 | Beyl | 280/618 |
| 3,752,491 | 8/1973 | Fend | 280/11.35 K |
| 3,764,155 | 10/1973 | Perryman | 280/11.35 Y |
| 3,797,843 | 3/1974 | Salomon | 280/11.35 K |
| 3,814,454 | 6/1974 | Beyl | 280/11.35 C |
| 3,825,273 | 7/1974 | Greene | 280/618 |
| 3,884,489 | 5/1975 | Gertsch et al. | 280/618 |
| 3,937,480 | 2/1976 | Korger | 280/618 |

FOREIGN PATENTS OR APPLICATIONS

| | | |
|---|---|---|
| 303,578 | 11/1972 | Austria |
| 270,468 | 4/1969 | Austria |
| 308,610 | 7/1973 | Austria |
| 310,631 | 10/1973 | Austria |
| 2,221,105 | 11/1972 | Germany |
| 2,051,758 | 4/1972 | Germany |
| 1,578,860 | 12/1970 | Germany |
| 2,157,791 | 6/1972 | Germany |
| 2,360,338 | 6/1974 | Germany |
| 460,610 | 9/1968 | Switzerland |
| 443,089 | 1/1968 | Switzerland |
| 300,633 | 10/1954 | Switzerland |

*Primary Examiner*—Joseph F. Peters, Jr.
*Assistant Examiner*—Milton L. Smith
*Attorney, Agent, or Firm*—Blanchard, Flynn, Thiel, Boutell & Tanis

[57] ABSTRACT

Safety ski binding including an intermediate plate and improved boot gripping means. A plate intermediate the boot and ski is mounted onto the ski by centrally positioned pivot means and held normally aligned with the ski by heel means which permits only limited swiveling movement of the plate with respect to the ski and only limited movement vertically of the plate away from the ski. Conventional toe engaging means are provided between the plate and the ski boot and said heel means also engage the heel of the ski boot, said means being arranged for releasing the ski boot from the plate upon movement of the plate a predetermined distance either vertically away from the ski or pivotally laterally of the ski. The ski boot is thus freed from said plate and said plate remains with the ski. After the ski boot is so freed from the ski the plate returns to its aligned position with respect to the ski and the apparatus is ready for re-engagement of the boot therewith.

13 Claims, 12 Drawing Figures

SAFETY SKI BINDING

FIELD OF THE INVENTION

The invention relates to a safety ski binding comprising a plate held on the ski boot and a locking device which in the zone of the boot tip cooperates with the plate and particularly to such a binding wherein the plate is secured to the ski by pivot means which are arranged substantially in the center zone of the plate.

BACKGROUND OF THE INVENTION

Such a safety ski binding is broadly known from Swiss Pat. No. 460610, published Sept. 30, 1968. In this known binding, the plate is arranged on the ski for lateral pivoting and is equipped at its rear with an automatic heel engaging means having forward release capability. Upon release of the locking device which in front cooperates with the boot plate, the plate can swivel laterally and upon forward release of the heel means the ski boot is released from the plate. A disadvantage of this known construction is, however, that during a torsion stress, the ski boot does not come free from the ski or from the plate. Instead, the ski boot is held in the pivoted position of the plate by the locking device.

In a further known device according to German OS No. 2221105, published Nov. 23, 1972, the ski boot is released from the ski during a torsion stress but it remains attached to the plate. This is a disadvantage because the ski boot during walking remains encumbered by the plate. Moreover, a subsequent entry into the holding devices provided on the ski is difficult with the additional plate because in such case the rotary plate must also be brought into engagement with the pivot pin.

A similar device is described in German OS No. 2051758, published Apr. 27, 1972. In this construction, the rear heel support device has a bearing block which is fixedly connected to the sole plate and serves as a guide part. The bearing block is equipped with a rearwardly sloped, steeply rising guide curve, in which the sole holder is guided by means of a slip joint. The holder is formed as a part of a control lever, which is a part of a control lever pair, in which the components are positioned angularly with respect to one another. The control lever which is positioned substantially vertically is held down by a lock lever, which releases the heel holder by swiveling. The bearing block also carries a locking member which is held by a locking device arranged behind the heel support device on the ski. The locking device consists substantially of a pivotable locking lever, which holds on one side the locking roller and on the other side is supported on a flexible locking piston. The sole plate is here also pivotable about an axis of rotation which is arranged substantially in the center area of the plate. If excessive forces act onto the ski boot, the sole plate slides out of the pivot pin, so that the plate is released along with the boot from the ski. The disadvantages of this device consist both in the boot being released with the sole plate from the ski and in that for voluntary and involuntary release special devices have to be provided.

In another known device according to German OS No. 1578860, published Dec. 10, 1970, two plates are provided, of which the one effects only the vertical release and the other the rotary release. After the release, the plate which is anchored in the ski remains connected to the ski, the locking mechanism for the second plate being secured on this plate. This construction has the disadvantage that, in order to obtain different release actions, two plates must be provided, which not only increases expense and weight and makes handling more difficult, but due to the excessively elevated position adversely affects the skiing.

For anchoring the known plate bindings, aside from the already mentioned references, still others are known which solve this problem in still further ways. For example, in German OS No. 2157791 published June 15, 1972, a locking part which engages the guideway is hinged to the front end of the release plate.

Further devices are known which have pistons with mushroom-shaped thrust pieces. Such as described for example in Swiss Pat. No. 443,089, published Jan. 3, 1968, or in Austrian Pat. No. 303,578, corresponds to U.S. Pat. No. 3,489,424. These mushroom-shaped connecting members have, however, the disadvantage that during the release the entire force is concentrated on a relatively small surface which causes considerable frictional resistance. Similar difficulties exist in an embodiment according to Swiss Pat. No. 300,633, published Oct. 16, 1954, wherein the frictional forces are created not only on the mushroom-shaped member but also on a conically constructed end piece.

In a known safety ski binding according to Austrian Pat. No. 270,468, published July 15, 1968, the jaw has a guide surface which engages a stop which is fixedly connected to the ski or the housing, a spring or the likke held on the ski or on the housing being hinged to one arm of the jaw. While this construction has nothing in common with a safety ski binding as such, in which the ski boot is secured on a plate, there is in this reference some suggestion for holding of the sole.

Finally, references are known which have a ski brake cooperating with the holding device. Such devices are for example known from Austrian Pat. No. 308,610, published Oct. 15, 1972 and No. 310,631, published Jan. 15, 1973, and German OS No. 2360338, published June 6, 1974. All these mentioned constructions have in common that they are held by the heel holder and upon release of the same free the ski brake.

SUMMARY OF THE INVENTION

The objective of the invention is to overcome in a safety ski binding of the above-mentioned type the listed disadvantages and to produce a holding or release device in which the plate assures both the objective of boot independence and also permits an easy automatic engagement.

This purpose is attained according to the invention by the plate being pivotable in a limited degree parallel to the ski plane on the pivot bearing while being unreleasably secured in the vertical direction relative to the ski plane.

The invention achieves a substantial new step in the field of the plate bindings. Due to the fact that the plate after the release remains anchored to the ski, the invention overcomes the disadvantages previously experienced in plate bindings wherein the plate after the release is removed with the ski boot from the ski. On the other hand, the disadvantage existing in the first-mentioned safety ski binding, that the ski boot is held by the plate anchored to the ski, is overcome in that after reaching a predetermined elasticity limit the ski boot is released from the plate.

A particularly advantageous embodiment of the invention is obtained by providing on the plate a spring-loaded holding device, which cooperates with a holding element anchored on the ski and by anchoring the front part of the plate releasably on the ski so that the plate moves elastically within a predetermined limit. Due to the elastic support of the plate, forces which are not dangerous for the skier are balanced out without causing the ski binding to release.

A preferred embodiment of the invention contemplates the rear anchoring device having a pivotable release member which is equipped with a support or holding part for the heel holder. This assures that even after covering a certain release path the anchoring device is not freed from the metal fitting, but instead the heel holder releases the boot whereby the plate remains anchored with the ski.

According to a further characteristic of the invention, the anchoring device has a piston which is guided in a conventional manner against the force of an adjustable spring in a cylinder and on its end facing the boot carries an approximately mushroom-shaped thrust piece, by means of which the anchoring device is held elastically in the metal fitting. This construction permits an elastic holding or anchoring between the holding device, the plate and the ski.

According to a further characteristic, the mushroom-shaped thrust piece is supported substantially with the edge area of its cap portion on a support surface of the anchoring device. This has the advantage that upon a stress only small frictional forces must be overcome.

In a further development of this characteristic, the support surface is arranged in an extended part of the cylinder. This has the advantage that the mushroom-shaped thrust piece can be guided or held in the guideway provided for the piston.

According to a different characteristic of the invention, the release member is formed as a two-arm lever, the one arm of which forms the support or holding part for the heel holder and the other arm comprises a release lever for effecting a voluntary release. In this manner, both the involuntary and the voluntary release are carried out by a single part.

A still further aspect of the invention resides in that a ski brake cooperates with the holding device, which in the starting position is held solely by the anchoring device and during the release is released by same.

According to a still further aspect of the invention, the front part of the plate defines with the ski a forwardly open angle of approximately 5° to 20°. This gives the plate a certain elasticity during a fall forwardly and permits at the same time the front holding device to be arranged below the plate.

In a further development of this inventive thought, the front holding device has a shoulder or the like which engages a recess of the counterpiece. It has been found to be especially advantageous to make this part as a resilient insert in order to achieve additional elasticity.

A still further feature of the invention lies in that the holding parts anchored to the ski are fastened by an adhesive to the ski. This measure permits a particularly simple type of fastening. A still further feature of the invention provides that the holding parts which are provided on the ski can be arranged releasably and securably in a rail which is fixedly connected to the ski. This construction has the advantage that the holding device can easily be adjusted to different plates for ski boots of different sizes.

Further advantages and details of the invention will be described more in detail in connection with the drawings, which illustrate one exemplary embodiment.

DETAILED DESCRIPTION

Figure 1:
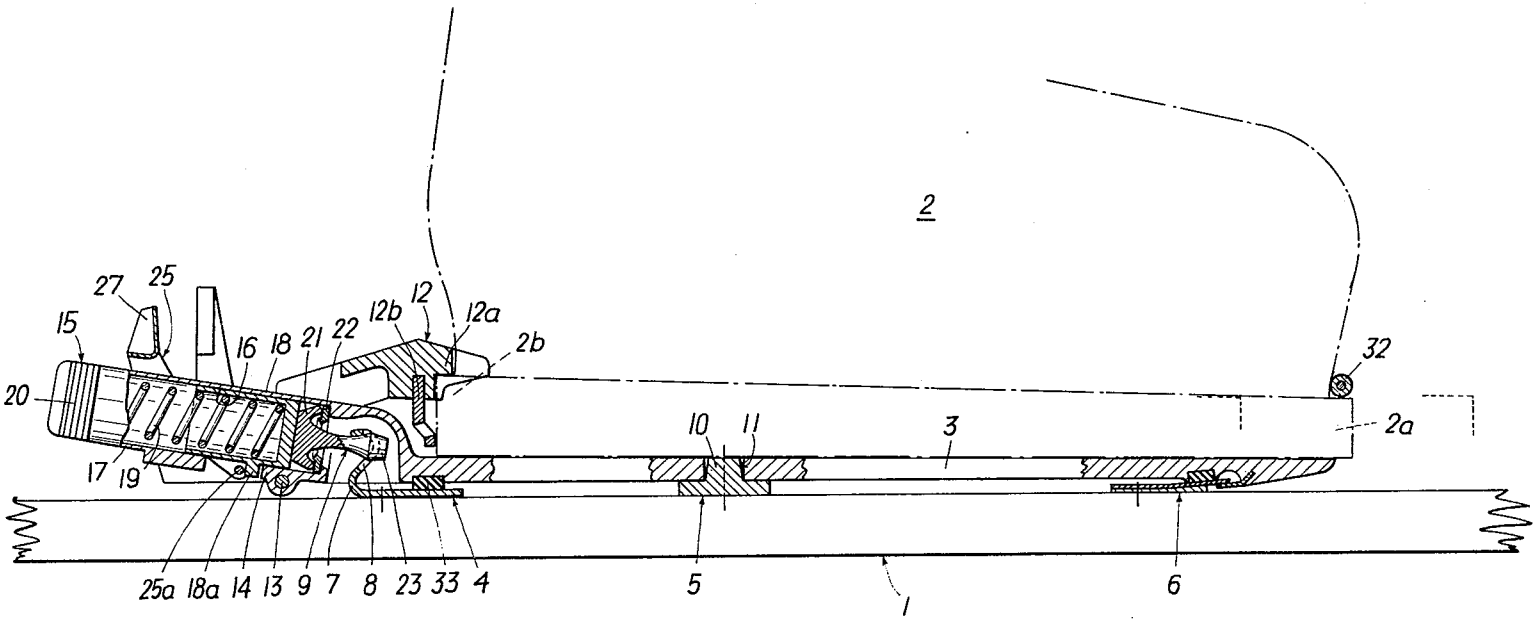
FIG. 1 is a longitudinal cross-sectional view of a safety ski binding embodying the invention.
Figure 2:
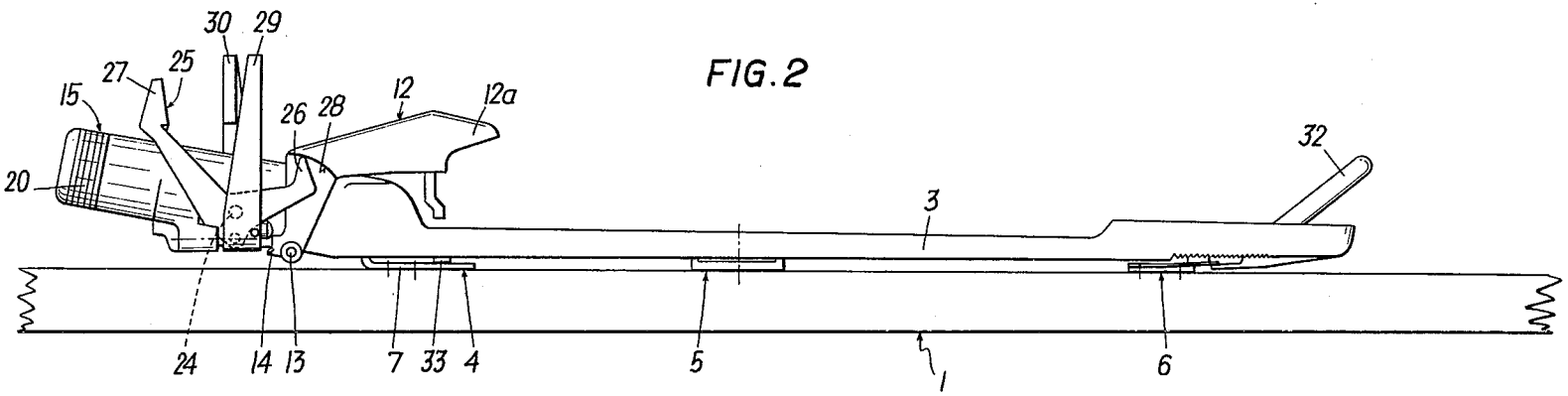
FIG. 2 is a side view of FIG. 1.
Figure 3:
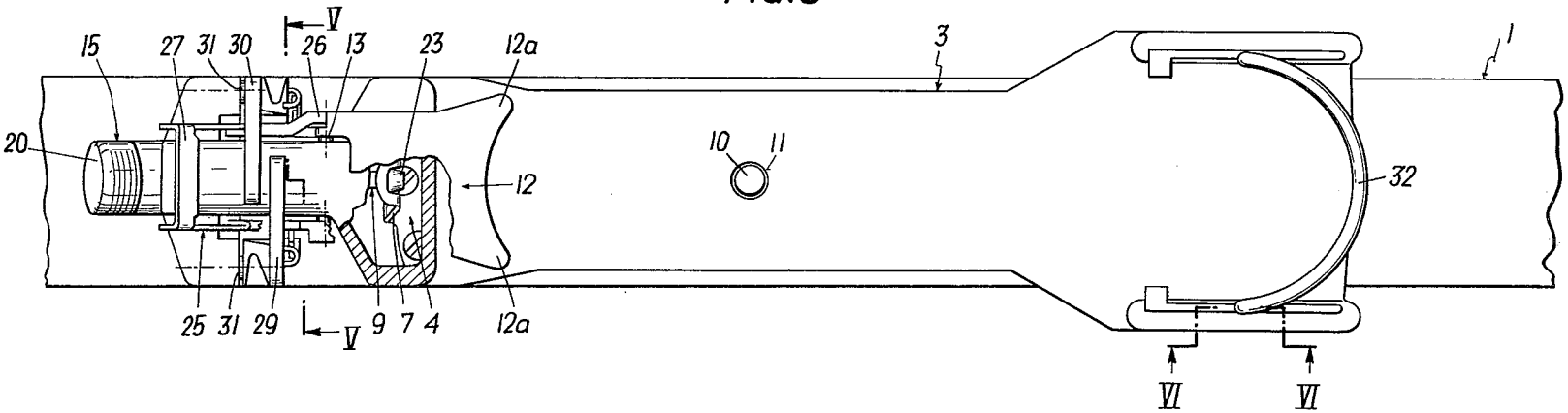
FIG. 3 is a top view of FIG. 2.
Figure 4A:
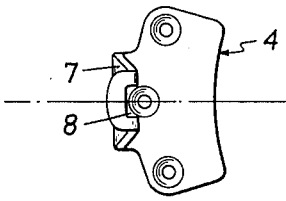
FIGS. 4*a* to 4*c* are top views of the holding parts secured on the ski omitting the plate provided thereabove.
Figure 4B:
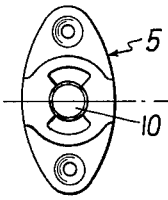
Figure 4C:
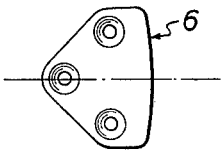

As shown in FIGS. 1 to 3, the ski boot 2, which is only indicated in FIG. 1, is arranged or held by the interpositioning of a plate 3. Metal fittings 4 to 6 (FIGS. 4*a*, 4*b* and 4*c*) are secured to the ski 1 by means of schematically illustrated screws which are shown in FIGS. 1 and 2 of the drawings simply as a centerline designation. The securement of the metal fittings 4 to 6 is accomplished with a drill jig in a conventional manner or the metal fittings can be adhesively secured directly onto the ski 1 or by means of an intermediate member. The metal fitting 4 as shown in FIG. 4*a* has an approximately Z-shaped and curved holding part 7 (see FIG. 1), wherein the center area of the curved holding part 7 has an opening 8 therethrough and serves to receive a thrust piece 9 which will be described in detail below.

The metal fitting 5 which engages the center area of the plate 3 has a pivot pin 10 which is received into a corresponding recess 11 in the plate 3.

The metal fitting 6 is arranged adjacent the front zone of the plate 3 and is unitarily formed as an elastic mounting, preferably as a plastic insert, which can engage an associated recess of the plate 3. As shown in FIGS. 1 and 2, the front lower part of the plate 3 is sloped, that is, inclined to the horizontal and defines with the ski 1 a forwardly opening angle of approximately 5° to 20°. This slope is advantageous to assure that the boot sole tip 2*a* projecting over the end of the plate can have a pivoting action even when same projects still further beyond the front edge of the plate 3 than as illustrated in FIG. 1. As one specific example, it has been found that at an angle of 5°, a projection of approximately 40 mm. is acceptable.

The boot heel 2*b* is held by a partially conventional heel apparatus 12. The heel apparatus 12 is pivotally supported about an axis of rotation 13 mounted on the plate 3. The heel apparatus 12 differs from conventional heel apparatus only insofar as same has in its lower area a shoulder 14 adjacent the pivot axis 13 on which rests a part of an anchoring device 15 which will be described in more detail. The anchoring device 15 has a cylindrical chamber 16 which is formed in a rearwardly angled holding part 17 of the plate 3. A piston 18 is guided in the cylindrical chamber 16, which piston can be moved rearwardly against the force of a spring 19 in said chamber 16. The initial stress of the spring 19 can be controlled by means of a conventional adjusting device 20, which includes several insert plates. The front side of the piston 18 is urged by the spring 19 into engagement with a thrust piece 9 which is formed approximately in the shape of a mushroom. The cap 21 of the mushroom shaped thrust piece 9, specifically the edge or rim of the cap 21, engages a surface of a support member 22 provided in the free part of the chamber 16 to support the thrust piece 9. The stem 23 of the thrust piece 9 extends through an opening in the support members 22 into the recess 8 of the holding part 7 and can be adjusted in same within pregiven limits.

A release member 25 is pivotally arranged for movement about a further pivot axis 24 (FIG. 2) which extends transversely to the longitudinal direction of the ski. The release member 25 is composed of a two-arm lever, the one arm of which forms a holding part 26 for the rear part 28 of the heel apparatus 12 and the other arm of which forms a release lever 27. In this manner the release member 25 is both a holding element for involuntary release and also an operating element for voluntary release.

Figure 5:
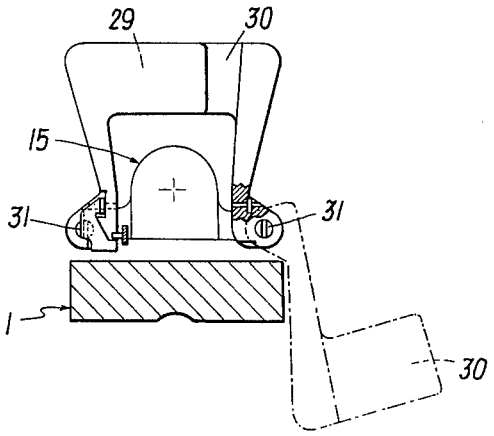
FIG. 5 is a cross-sectional view of FIG. 3 along the line V—V.

A ski brake 29 is held on the ski in the starting position by the heel apparatus 12, which ski brake is also released during a release of the boot as yet to be described, whereby a wing-shaped brake part 30 (FIG. 5) is moved into braking position about a pivot axis 31 extending in the longitudinal direction of the ski. Since such ski brakes are already known, further description and discussion thereof is unnecessary.

The tip 2*a* of the boot sole is held on the plate 3 by means of a conventional holding element 32. The type of securement of the holding element 32 on the plate 3 will be described in detail later on in connection with FIG. 6.

A guide plate 33 can be provided on the metal fitting 4 as shown in FIG. 1, which guide plate increases the elasticity of the plate 3 on the ski.

FIGS. 2 and 3 illustrate details of the parts which are shown in FIG. 1 and already described, which details do not appear in all respects in FIG. 1. In this connection it may be pointed out that the release member 25, as shown in FIG. 3, extends on both sides of, that is, straddles the housing for the cylindrical chamber 16. In FIG. 3 the sole holder 12*a* has been broken away to permit illustration in a top view of the anchoring of the thrust piece 9 in the holding part 7.

Figure 6:
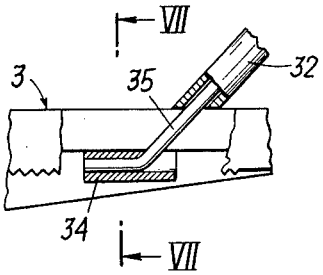
FIG. 6 is a cross-sectional view along the line VI—VI of FIG. 3.
Figure 7:
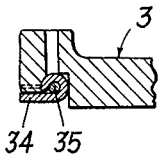
FIG. 7 is a cross-sectional view along the line VII—VII of FIG. 6.

FIGS. 2, 3, 6 and 7 illustrate details of the front fastening device. The holding element 32 extends circularly along the tip 2*a* of the boot sole and is secured below the front part of the plate 3. For this purpose, as shown in FIG. 6, an anchoring device 34 is provided below the plate 3 into which anchoring device 34 is provided below the plate 3 into which anchoring device there engages a bent holding piece 35. To better illustrate the construction of this holder, FIG. 7 illustrates a cross-sectional view along the line VII—VII of FIG. 6. As shown in FIG. 7, the anchoring device 34 encircles the holding piece 35 and the anchoring device itself is clamped between parts of the plate 3.

OPERATION

Figure 8:
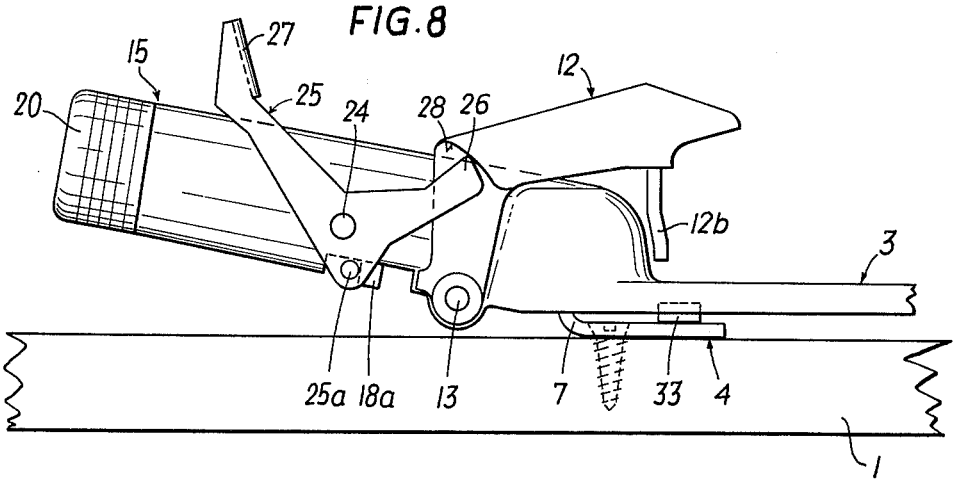
FIG. 8 is a side elevation, with certain parts omitted to expose other operating parts, of the heel holding apparatus in its holding position.
Figure 9:
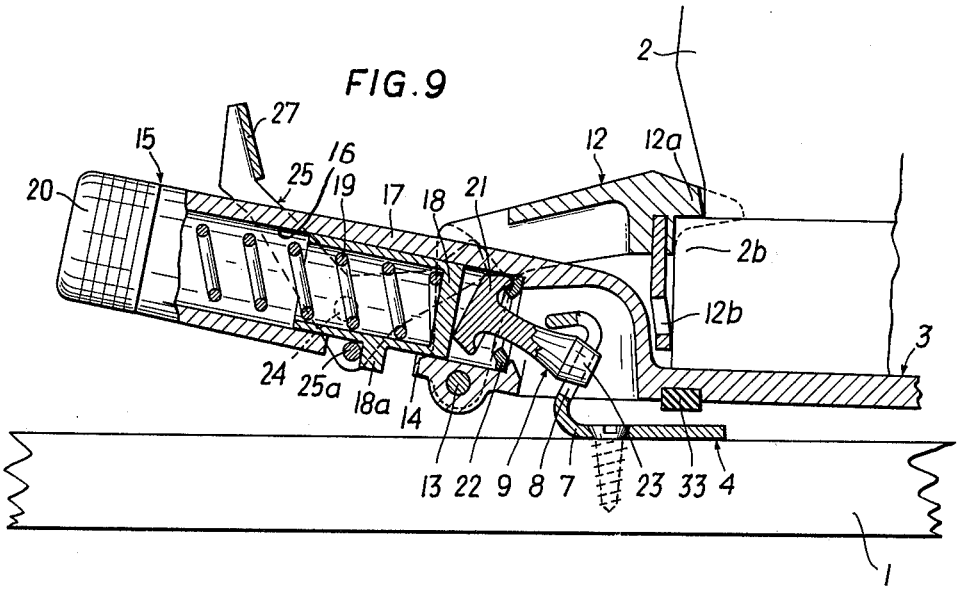
FIG. 9 is a central longitudinal section similar to FIG. 1 showing the device in an enlarged scale and in partially released position.
Figure 10:
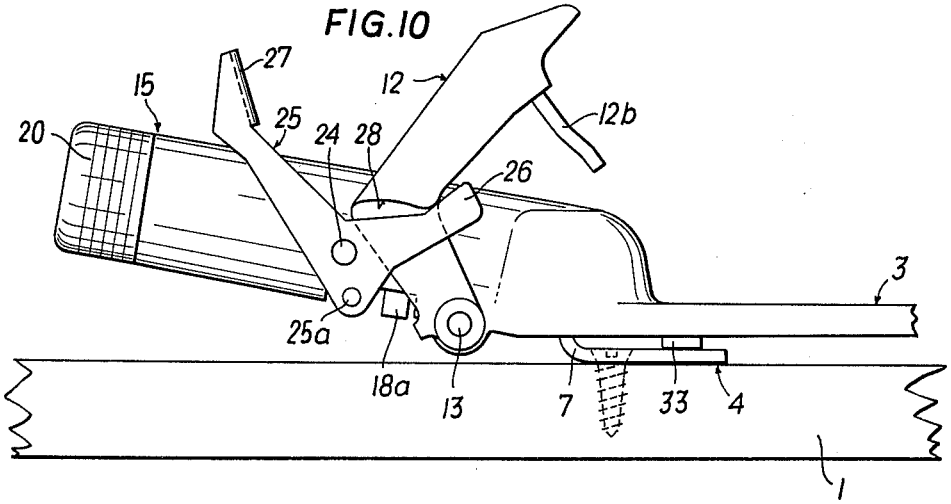
FIG. 10 is a side elevation similar to FIG. 8 showing the device in a boot releasing position.

The safety ski binding of the invention is operated as follows. To place the ski boot 2 on the ski 1, the boot tip 2*a* is guided into the holding element 32 and the boot heel 2*b* is stepped down, whereby through the simultaneously stepped-down spur 12*b* of the holder 12 the sole holder 12*a* brings the ski boot 2 into the engaged position. The support or holding part 26 of the control member 25 is engaged by the curved track 28 of the holder 12 and the already described self-locking locking position is created. If now an external force in any direction, namely upwardly, laterally or diagonally, acts onto the plate 3, same may be displaced to a predetermined amount without releasing the ski boot 2. Until the predetermined deflections are reached, the thrust piece 9 remains locked in the holding part 7. When the external force exceeds these values, then the thrust piece 9 is still further swiveled in the holding part 7, so that the cam 18*a* (FIG. 9) of the piston 18 contacts the stop 25*a* of the control member 25 and rotates same to the right (clockwise in FIGS. 2 and 8) against the force of the prestressing spring. The end of the support or holding part 26 moves in response thereto along the curved track 28 of the holder 12 downwardly and eventually leaves same so that the holder 12 swings rearwardly under its initial stress, namely to the left, and releases the boot heel 2*b* of the boot 2. By releasing the boot 2, the external force which acted onto the plate 3 is suddenly cancelled and through the now freed spring 19 the piston 18 and the thrust piece 9, and thus also the plate 3, are all returned to their initial positions. The control member 25 and the holder 12 are now again in the position to receive a ski boot.

Upon insertion of the ski boot, the spur 12*b* is stepped down by the boot heel 2*b*, so that the holder 12 is closed in clockwise direction against its initial stress. The end of the holding part 26 thus slides again on the curved track 28 and again holds the boot in the starting position.

The invention is not limited to the illustrated exemplary embodiment. There are a number of variations which all lie within the scope of the invention. To control the heel apparatus it is also possible to use the piston. In place of the particular ski brake mentioned, different types of conventional or newly developed ski brakes can be used. It is also conceivable to use a safety strap in place of the ski brake.

The heel holding device can be controlled differently, for example by a tensioning device, which is controlled also by a release member and/or by the longitudinally movable piston.

To hold the boot tip, a cup or bar sole holding device can be used. It is also conceivable to use the plate without the center axis of rotation. The control mechanism and the ski brake can also be mounted on the ski separately from the plate.

All these solutions can be combined partly and/or among one another with the construction discussed in relationship to the drawings.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A releasable binding for a ski boot, comprising:
a sole plate;
means centrally located relative to said sole plate for pivotally securing said sole plate to a ski;
spaced holder means for releasably holding said ski boot onto said sole plate;
resilient means adjacent one end of said sole plate for resiliently maintaining the longitudinal axis of said sole plate in alignment with the longitudinal axis of said ski and for permitting a pivotal movement of said sole plate relative to said ski between predefined limits without effecting a release of said ski boot from the holding engagement by said spaced holder means, said resilient means including a holding element secured to said ski, a locking element mounted on said sole plate and a spring for urging said locking element into engagement with said holding element and permitting said relative pivotal movement between said sole plate and said ski against the urging of said spring; and
support means adjacent the other end of said sole plate for supporting said sole plate on said ski throughout the range of pivotal movement of said sole plate, said resilient means and said support means maintaining said pivotal securement of said sole plate to said ski throughout positions of pivotal movement thereof, said spaced holder means including release means responsive to a relative pivotal movement between said sole plate and said ski which exceeds said predefined limits for releasing said ski boot therefrom, said spring effecting a return of said sole plate to an aligned position on said ski immediately following said release of said ski boot.

2. A releasable binding according to claim 1, including ski brake means deployable in response to an actuation of said release means.

3. A releasable binding according to claim 1, wherein said spaced holder means includes first and second holders, said first holder being located adjacent the toe of said sole plate, said second holder being located adjacent the heel of said sole plate;
wherein said release means effects a release of said second holder to release said ski boot from said sole plate.

4. A releasable binding according to claim 1, wherein the underside of the end said sole plate adjacent the toe of said ski boot is inclined relative to the upper surface of said ski at an angle of 5° to 20°.

5. A releasable binding according to claim 1, wherein said support means includes a metal fitting secured to said ski; and
wherein one of said sole plate and said metal fitting has a shoulder thereon and the other of said sole plate and said metal fitting has a recess therein for receiving said shoulder.

6. A releasable binding for a ski boot, comprising:
a sole plate;
means centrally located relative to said sole plate for pivotally securing said sole plate to a ski;
spaced holder means for releasably holding said ski boot onto said sole plate;
resilient means adjacent one end of said sole plate for resiliently maintaining the longitudinal axis of said sole plate in alignment with the longitudinal axis of said ski and for permitting a pivotal movement of said sole plate relative to said ski between predefined limits, said resilient means including means permitting said relative pivotal movement of said sole plate and ski between said predefined limits without effecting a release of said ski boot from the holding engagement by said spaced holder means; and
support means adjacent the other end of said sole plate for supporting said sole plate on said ski throughout the range of pivotal movement of said sole plate, said spaced holder means including release means responsive to a relative pivotal movement between said sole plate and said ski which exceeds said predefined limits for releasing said ski boot therefrom, said spaced holder means further including first and second holders, said first holder being located adjacent the toe of said sole plate, said second holder being located adjacent the heel of said sole plate, said release means effecting a release of said second holder to release said ski boot from said sole plate, said release means including a two arm lever and first pivot means for pivotally securing said two arm lever to said sole plate adjacent said second holder and second pivot means for pivotally securing said second holder to said sole plate, one arm of said two arm lever being in blocking engagement with said second holder to prevent a pivoting of said second holder, the other arm of said two arm lever defining a manually engageable release lever for permitting a voluntary pivoting of said two arm lever to move said one lever out of blocking engagement with said second holder.

7. A releasable binding according to claim 6, wherein said two arm lever further includes a first stop member thereon radially spaced from said first pivot means;
wherein said resilient means includes housing means on said sole plate having an elongated chamber therein, a thrust member mounted in said chamber, adjustable spring means for urging said thrust member toward one end of said chamber and a holding element secured to said ski, said thrust member having a stem member thereon extending in a direction parallel to the axis of said chamber and movable therewith and engaging said holding element;
wherein said resilient means further includes a piston member reciprocally mounted in said chamber, said adjustable spring means engaging one side of said piston member and urging said piston member into engagement with said thrust member; and
wherein said piston member has a second stop thereon and movable therewith into and out of engagement with said first stop member for effecting a pivoting of said two arm lever about said first pivot means when said first stop member engages said second stop member.

8. A releasable binding according to claim 7, wherein the spacing between said first and second stop members when said sole plate is axially aligned with said ski is proportional to said predefined limits of said relative movement permitted between said sole plate and said ski.

9. A releasable binding for a ski boot, comprising:
a sole plate;
means centrally located relative to said sole plate for pivotally securing said sole plate to a ski;

spaced holder means for releasably holding said ski boot onto said sole plate;

resilient means adjacent one end of said sole plate for resiliently maintaining the longitudinal axis of said sole plate in alignment with the longitudinal axis of said ski and for permitting a pivotal movement of said sole plate relative to said ski between predefined limits; and support means adjacent the other end of said sole plate for supporting said sole plate on said ski throughout the range of, pivotal movement of said sole plate, said resilient means including housing means on said sole plate having an elongated chamber therein, a thrust member mounted in said chamber, adjustable spring means for urging said thrust member toward one end of said chamber and a holding element secured to said ski, said thrust member having a stem member thereon extending in a direction parallel to the axis of said chamber and movable therewith and engaging said holding element.

10. A releasable binding according to claim 9, wherein said thrust member and said stem member are a monolithic unit defining a thrust piece, said thrust member having an annular rim on the side thereof remote from said adjustable spring means; and wherein said housing means includes a stop at said one end of said chamber for engaging said rim and limiting the movement of said thrust piece in one direction, said stem member, upon having a transverse force applied thereto, pivoting within said chamber against the urging of said adjustable spring about an axis located at a place of contact between said rim and said stop so that said stem member is out of axial alignment with said chamber.

11. A releasable binding according to claim 10, wherein said resilient means further includes a piston member reciprocally mounted in said chamber, said adjustable spring means engaging one side of said piston member and urging said piston member into engagement with said thrust piece.

12. A releasable binding for a ski boot, comprising:

a sole plate;

means for pivotally securing said sole plate to a ski;

first holder means for releasably holding the toe of said ski boot onto said sole plate;

second holder means for releasably holding the heel of said ski boot onto said sole plate;

resilient means for resiliently maintaining the longitudinal axis of said sole plate in alignment with the longitudinal axis of said ski and for permitting a pivotal movement of said sole plate relative to said ski between predefined limits without effecting a release of said ski boot from the holding engagement by said first and second holder means; and release means operatively connected to one of said first and second holder means and responsive to a relative pivotal movement between said sole plate and said ski that exceeds said predefined limits for effecting a release of said one of said first and second holder means from engagement with said ski boot, said resilient means effecting a return of said sole plate to an aligned position on said ski immediately following said release of said ski boot, said release means including a two arm lever and first pivot means for pivotally securing said two arm lever to said sole plate adjacent said second holder means and second pivot means for pivotally securing said second holder means to said sole plate, one arm of said two arm lever being in blocking engagement with said second holder means to prevent a pivoting of said second holder means, the other arm of said two arm lever defining a manually engageable release lever for permitting a voluntary pivoting of said two arm lever to move said one lever out of blocking engagement with said second holder means.

13. A releasable binding according to claim 12, wherein said two arm lever further includes a first stop member thereon radially spaced from said first pivot means;

wherein said resilient means includes housing means on said sole plate having an elongated chamber therein, a thrust member mounted in said chamber, adjustable spring means for urging said thrust member toward one end of said chamber and a holding element secured to said ski, said thrust member having a stem thereon extending in a direction parallel to the axis of said chamber and movable therewith and engaging said holding element;

wherein said resilient means further includes a piston member reciprocally mounted in said chamber, said adjustable spring means engaging one side of said piston member and urging said piston member into engagement with said thrust member; and wherein said piston member has a second stop thereon and movable therewith into and out of engagement with said first stop member for effecting a pivoting of said two arm lever about said first pivot means when said first stop member engages said second stop member.

* * * * *